United States Patent [19]

Charlot, Jr.

[11] Patent Number: 5,022,244

[45] Date of Patent: Jun. 11, 1991

[54] PIN-CLUTCH MECHANISM FOR THEFT-DETERRENT DEVICE

[75] Inventor: Lincoln H. Charlot, Jr., St. Petersburg, Fla.

[73] Assignee: Security Tag Systems, Inc., St. Petersburg, Fla.

[21] Appl. No.: 529,940

[22] Filed: May 29, 1990

[51] Int. Cl.[5] ..... B65D 55/10

[52] U.S. Cl. ..... 70/57.1; 24/706.8; 335/301

[58] Field of Search ..... 70/57.1, 386; 340/572; 24/706.8, 704.1, 635, 453; 335/301, 306, 295; 411/348

[56] References Cited

U.S. PATENT DOCUMENTS

| | | | |
|---|---|---|---|
| 2,993,152 | 6/1961 | Pierce et al. | 335/301 |
| 3,858,280 | 1/1975 | Martens et al. | 70/57.1 |
| 4,012,813 | 3/1977 | Martens et al. | 70/57.1 |
| 4,339,853 | 7/1982 | Lipschitz | 70/57.1 |
| 4,523,356 | 6/1985 | Charlot, Jr. | 24/706.8 |
| 4,527,310 | 7/1985 | Vandebult | 70/57.1 |
| 4,651,136 | 3/1987 | Anderson et al. | 340/572 |
| 4,903,383 | 2/1990 | Gartshore | 340/572 |

*Primary Examiner*—Gary L. Smith
*Assistant Examiner*—Darnell M. Boucher
*Attorney, Agent, or Firm*—Edward W. Callan

[57] ABSTRACT

A clutch mechanism includes a ferromagnetic anvil having an axial bore for axially receiving a pin; a cup axially aligned with the anvil for receiving a pin that is axially received by the bore of the anvil, wherein the anvil is longitudinally movable along its bore axis with respect to the cup; a spring for forcing the anvil toward a confining end of the cup; balls in the cup for engaging the pin when the anvil is forced toward the confining end of the cup, with the balls being disposed to apply radial pressure against the pin to firmly clutch the pin and thereby restrain the pin from longitudinal movement when the balls are forced toward the confining end of the cup; and a ferromagnetic shield disposed axially in relation to the anvil for diffusing magnetic flux applied axially to the anvil by a magnet external to the clutch mechanism so as to prevent less than a predetermined amount of the axially applied magnetic flux from overcoming the spring and forcing the anvil to move away from the confining end of the cup. The clutch mechanism further includes a radially disposed pole piece for directing magnetic flux applied radially by a pole piece coupled to the magnet so that at least a predetermined amount of the radially applied magnetic flux is so concentrated axially in the anvil as to overcome the force of the spring and force the anvil to move away from the first end of the cup.

15 Claims, 1 Drawing Sheet

FIG. 1
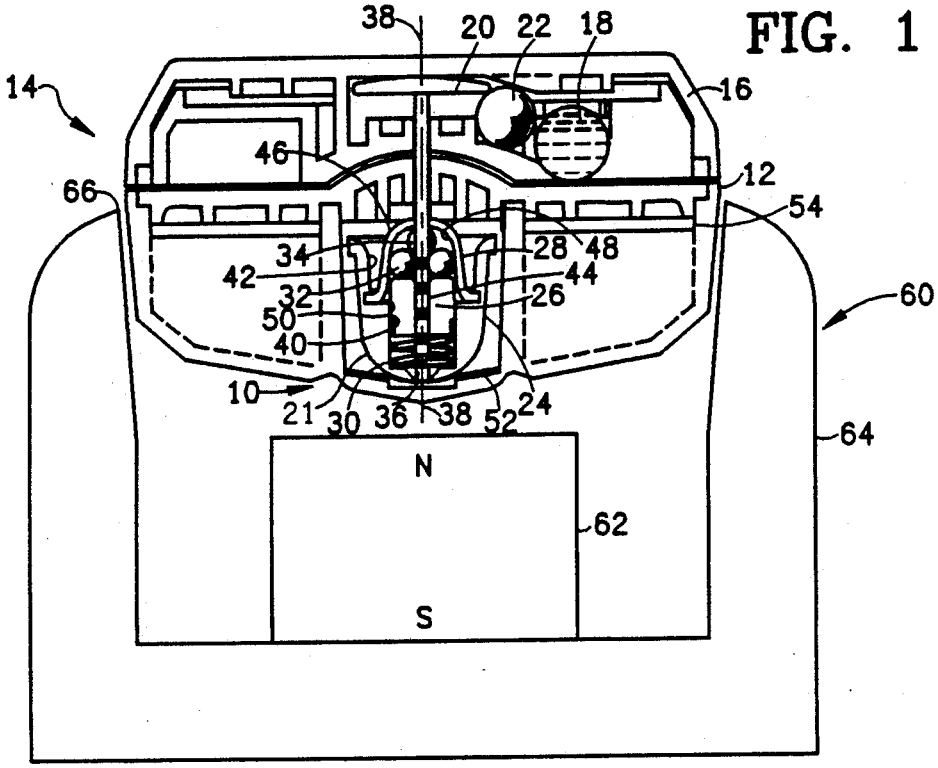
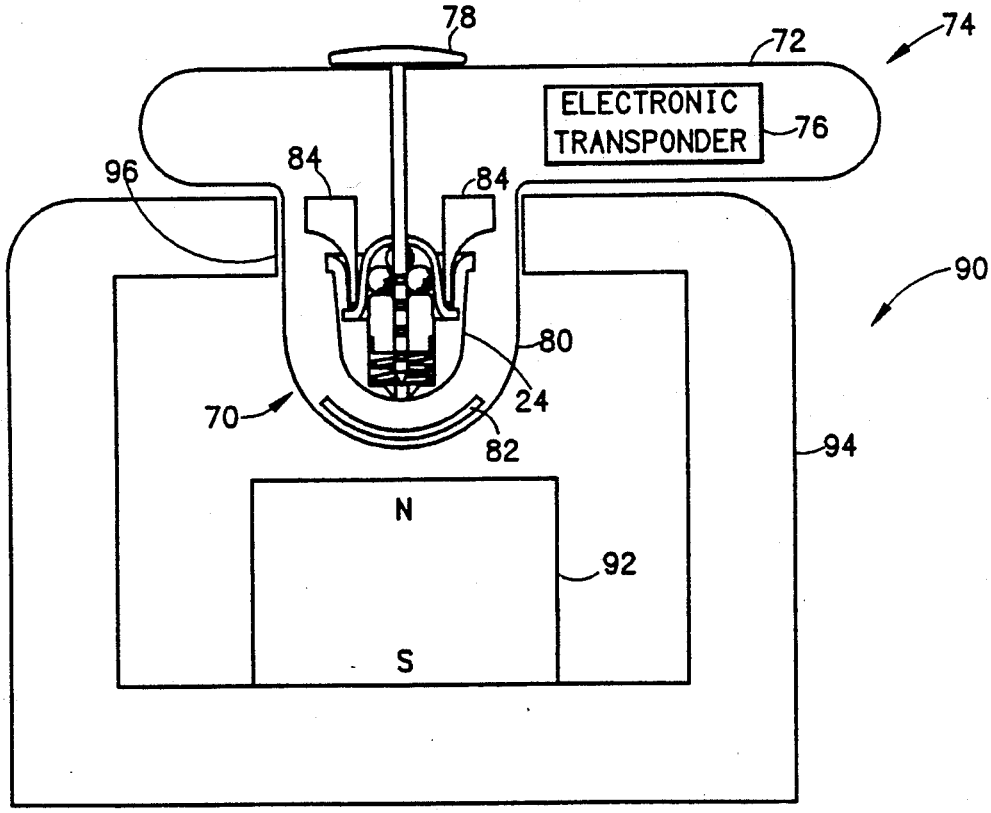
FIG. 2

PIN-CLUTCH MECHANISM FOR THEFT-DETERRENT DEVICE

BACKGROUND OF THE INVENTION

The present invention is generally directed to pin-clutch mechanisms and is particularly directed to an improvement in pin-clutch mechanisms of the type in which the pin is released from the clutch in response to application of a magnetic field. The present invention is further directed to an improvement in theft-deterrent devices of the type that include pin-clutch mechanisms.

Theft-deterrent devices are attached to articles, such as merchandise, for deterring the theft of such articles. Theft-deterrent devices of the type that contains a detrimental fluid substance that damages a protected article attached to the device by releasing such substance when the device is tampered with during an unauthorized attempt to remove the device from the article are described in U.S. patent application Ser. No. 07/360,842 filed June 1, 1989 by Lincoln H. Charlot, Jr. and Carter W. Clarke, Jr., in U.S. Pat. No. 4,944,075 filed Sept. 18, 1989 by Dennis L. Hogan and in U.S. Pat. No. 4,670,950 to Wisecup et al. Theft-deterrent devices of the type that function electronically to produce an alarm if an article to which the device is attached is removed from monitored premises without the device first being removed from the article are described in U.S. Pat. Nos. 4,481,428 to Lincoln H. Charlot, Jr.; 4,654,641 to Lucian G. Ferguson and Lincoln H. Charlot, Jr.; 4,670,740 to Fred Wade Herman and Lincoln H. Charlot, Jr.; and 4,727,360 to Lucian G. Ferguson and Lincoln H. Charlot, Jr.

Typically, the theft-deterrent device includes means for attaching the device to the article with the attaching means being embodied in two components that are adapted to be locked together on opposite sides of a portion of said article to prevent unauthorized removal of the device from the article. A typical attaching means includes a pin embodied in one of the two components and means embodied in the other component for receiving and clutching the pin. The device is attached to the protected article by passing the pin through a portion of the article and into the clutch of the other component.

A typical clutch mechanism for restraining a pin from longitudinal movement whereby the pin could not be removed from the other component in order to enable the theft deterrent device to be removed from the article includes a ferromagnetic anvil having an axial bore for axially receiving a pin; receiving means axially aligned with the anvil for axially receiving a said pin that is axially received by the bore of the anvil, wherein the anvil is longitudinally movable along its bore axis with respect to the receiving means; biasing means for forcing the anvil toward a first end of the receiving means; clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means. In order to remove the pin from the clutch mechanism, magnetic flux is applied axially in relation to the anvil to force the anvil to move away from the first end of the receiving means. A clutch mechanism of this type that is used in theft deterrent devices is described in U.S. Pat. No. 4,523,356 to Lincoln H. Charlot, Jr.

SUMMARY OF THE INVENTION

The present invention provides a clutch mechanism of this type that is improved by the presence of means that increase the amount of magnetic flux that must be applied to remove the pin from the clutch mechanism and thereby make such removal more difficult in that means for applying a large amount of magnetic flux are not commonly available nor easily concealable by a shoplifter. The clutch mechanism of the present invention includes a ferromagnetic anvil having an axial bore for axially receiving a pin; receiving means axially aligned with the anvil for axially receiving a said pin that is axially received by the bore of the anvil, wherein the anvil is longitudinally movable along its bore axis with respect to the receiving means; biasing means for forcing the anvil toward a first end of the receiving means; clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means; and means disposed axially in relation to the anvil for diffusing magnetic flux applied axially to the anvil by means external to the mechanism so as to prevent less than a predetermined amount of said axially applied magnetic flux from overcoming the biasing means and forcing the anvil to move away from the first end of the receiving means. The anvil is disposed between the receiving means and the diffusing means.

The present invention further provides a clutch mechanism of this improved type that is further improved by further including a radially disposed pole piece for directing magnetic flux applied radially by means external to the mechanism so that at least a predetermined amount of said radially applied magnetic flux is so concentrated axially in the anvil as to overcome the biasing means and force the anvil to move away from the first end of the receiving means. In order to remove a pin from such an improved clutch mechanism, one must use a magnetic flux source that applies magnetic flux radially to the clutch mechanism and thereby is of such construction that it is not easily concealable by a shoplifter.

The present invention further provides a method of removing a pin from such a further improved clutch mechanism, and apparatus for use in effecting such removal.

The present invention also provides a theft deterrent device including the improved clutch mechanism of the present invention.

Additional features of the present invention are described in relation to the description of the preferred embodiments.

BRIEF DESCRIPTION OF THE DRAWING

FIG. 1 is a sectional view of one preferred embodiment of the clutch mechanism of the present invention contained in one type of theft deterrent device and shown in combination with one embodiment of an apparatus that may be used for removing a pin from the clutch mechanism.

FIG. 2 is a sectional view of another preferred embodiment of the clutch mechanism of the present invention contained in another type of theft deterrent device and shown in combination with another embodiment of an apparatus that may be used for removing a pin from the clutch mechanism.

DESCRIPTION OF THE PREFERRED EMBODIMENTS

Referring to FIG. 1, one preferred embodiment of the clutch mechanism 10 of the present invention is contained in a first component 12 of a two-component theft-deterrent device 14 of the type that contains a detrimental fluid substance. The second component 16 of the device 14 contains the detrimental substance in a fragile vial 18. The second component 16 also contains a pin 20, which is engaged by the clutch mechanism 10 when the first component 12 is attached to the second component 16 to prevent unauthorized separation of the first and second components. The second component 16 further contains a ball 22 disposed between the head of the pin 20 and the vial 18 for movement into the vial 18 for fracturing the vial to release the detrimental substance in response to movement of the pin 20 caused by an attempt to pry the first component 12 apart from the second component 16. This type of theft-deterrent device is described in more detail in the aforementioned U.S. Pat. No. 4,944,075.

The preferred embodiment of the clutch mechanism 10 is a ball clutch mechanism as described in the aforementioned U.S. Pat. No. 4,523,356. The clutch mechanism 10 includes a housing 24 that contains a ferromagnetic anvil 26, a cup 28, a spring 30, a first set of two balls 32 and a second set of two balls 34. All of the balls 32, 34 are uniformly dimensioned.

The interior of the housing 24 is symmetrical. The housing 24 has a substantially confining end 21 and includes a small axial bore 36 in the confining end 21 for admitting the pin 20 longitudinally along the axis 38 of the bore 36.

Communicating with the small bore 36 is a larger axial bore 40 along the axis 38. The larger axial bore 40 contains the spring 30, which is disposed to exert force longitudinally along the common axis 38. One end of the spring 30 is supported by the confining end 21 of the housing 24 and the other end of the spring 30 engages a spring guide at the periphery of the anvil 26.

The anvil 26 is made of a magnetic material which can be attracted by an electromagnet so as to draw the anvil 26 against the force of the spring 30 toward the confining end 21 of the housing 24. The anvil 26 is generally cylindrical and is dimensioned radially to closely fit within the larger bore 40 of the housing 24.

The housing 24 has a still larger axial bore 42 communicating with the large bore 40 along the common axis 38. The still larger bore 42 contains the cup 28.

The anvil 26 has an axial bore 44 for axially receiving the pin 20 along the common axis 38.

The cup 28 is radially symmetrical. The cup 28 has a confining end 46, a tapered interior wall 48 and a predominantly open end 50 covering the anvil 26. The cup 28 has a small axial opening in its confining end 46 and is axially aligned with the anvil along the common axis 38 for axially receiving the pin 20. The cup 28 is made of stainless steel.

The anvil 26 is longitudinally movable along the common axis 38 with respect to the cup 28. The spring 30 is positioned for forcing the anvil 26 toward the confining end 46 of the cup 28.

The first set of balls 32 engage the anvil 26 and are forced by the anvil 26 toward the confining end 46 of the cup by the spring 30.

The second set of balls 34 is positioned in the extreme confining end 46 of the cup 28 for clutching the pin 20. The interior wall 48 of the cup 28 is dimensioned and tapered with respect to the balls 32, 34 to cause the balls 32 of the first set to be in a different radial plane from the balls 34 of the second set and to cause the balls 34 of the second set to contact the pin 20. When the balls 32 of the first set are forced toward the confining end 46 of the cup 28 by the force of the spring 30 on the anvil 26, the balls 32 of the first set wedge the balls 34 of the second set between the tapered interior wall 48 of the cup 28 and the pin 20 and uniformly space the balls 34 of the second set to apply symmetrical radial pressure against the pin 20 to firmly clutch the pin 20 and thereby restrain the pin 20 from longitudinal movement. All of the balls 32, 34 are stainless steel ball bearings.

The surface of the anvil 26 that engages the first set of balls 32 is shaped to have a uniform outward concave contour in order to prevent the balls 32 of the first set from touching the pin 20 when the anvil 26 is forced toward the confining end 46 of the cup 28. The contour of the concave surface has the same radius as the balls 32 of the first set.

The pin 20 has a point and a head for enabling the ball clutch mechanism to be attached to an article by inserting the pointed end of the pin 20 through the article, through the small opening in the cup 28 and into the bore 44 of the anvil 26. The pin 20 includes circumferential notches for engaging the second set of balls 34 when the pin 20 is inserted into the anvil bore 44. The notches provide the user of the ball clutch mechanism with a sense of pin insertion depth and enhance the clutch of the second set of balls 34 on the pin 20. The pin 20 is made of stainless steel.

The clutch mechanism 10 further includes a ferromagnetic shield 52 that is disposed axially in relation to the anvil 26 for diffusing magnetic flux applied axially to the anvil by means external to the clutch mechanism 10 so as to prevent less than a predetermined amount of said axially applied magnetic flux from overcoming the biasing force applied by the spring 30 and forcing the anvil 26 to move away from the confining end 46 of the cup 28. The shield 52 is positioned at the opposite end of the clutch mechanism 10 from the confining end 46 of the cup 28.

The clutch mechanism 10 is so constructed that magnetic flux must be applied radially to the clutch mechanism 10 in order to force the anvil 26 to overcome the biasing force applied by the spring 30 and move away from the confining end 46 of the cup 28 to release the pin 20 from the grasp of the first set of balls 32 so that the first component 12 can be separated from the second component 16. To axially concentrate radially applied flux in the anvil 26 in order to overcome the biasing force of the spring 30 and force the anvil 26 to move away from the confining end 46 of the cup 28, the clutch mechanism 10 includes a ferromagnetic pole piece 54 that is radially disposed for directing magnetic flux applied radially by means external to the clutch mechanism 10 so that at least a predetermined amount of said radially applied magnetic flux is so concentrated axially in the anvil 26. In this embodiment, the pole piece 54 is a ferromagnetic disc-shaped ring that is disposed adjacent the confining end of the cup 30 in a plane that is perpendicular to the bore axis 38.

Magnetic flux is radially applied to the clutch mechanism 10 of the theft deterrent device 14 when the theft deterrent device 14 is positioned in a magnetic flux source apparatus 60 that is particularly designed for radially applying magnetic flux to such clutch mechanism 10. The magnetic flux source apparatus 60 includes a magnet 62 and a ferromagnetic pole piece 64.

The magnet 62 provides in excess of said predetermined amount of magnetic flux, and has a North-South magnetic axis that is aligned with the bore axis 38 of the clutch mechanism 10 when the theft deterrent device 14 is positioned within the magnetic flux source apparatus 60 as shown in FIG. 1. One pole of the magnet 62 contacts the pole piece 64.

The pole piece 64 is disposed coaxially with the magnet 62 and includes a coaxial shell having a horizontal base and a generally vertical wall that terminates in a rim 66 from which magnetic flux in excess of said predetermined amount of magnetic flux is applied radially toward the axis of the magnet 62. The radially applied flux from the rim 66 of the pole piece 64 initially flows toward the axis of the magnet 62 in a plane that is beyond the magnet 62 and aligned with the radially disposed pole piece 54 of the clutch mechanism 14 when the theft deterrent device 14 is positioned within the magnetic flux source apparatus 60 as shown in FIG. 1.

The shape of the pole piece 54 of the clutch mechanism 10 is that of a disc-shaped ring so that the pole piece extends close to the rim 66 of the pole piece 64 when the theft deterrent device 14 is positioned within the magnetic flux source apparatus 60 as shown in FIG. 1.

When the theft deterrent device 14 is positioned within the magnetic flux source apparatus 60 as shown in FIG. 1, the pole piece 54 of the clutch mechanism 10 is so disposed in relation to the pole piece 64 of the magnetic flux source apparatus 60 as to direct the magnetic flux that is applied radially by the pole piece 64 of the magnetic flux source apparatus and to concentrate at least said predetermined amount of said radially applied magnetic flux in the anvil 26 to thereby overcome the bias force applied by the spring 30 and force the anvil 26 to move away from the confining end 46 of the cup 28.

Referring to FIG. 2, another preferred embodiment of the clutch mechanism 70 of the present invention is contained in a first component 72 of a two-component theft-deterrent device 74 of the type that contains an electronic transponder 76 which causes an alarm to be produced if an article to which the device 74 is attached is removed from monitored premises without the device first being removed from the article. Such theft deterrent devices are described in the aforementioned U.S. Pat. Nos. 4,481,428; 4,654,641; 4,670,740 and 4,727,360. The first component 72 of the device 74 also contains the electronic transponder 76. The second component 78 of the device 74 consists of a pin 78, which is engaged by the clutch mechanism 70 when the first component 72 is attached to the second component 78 to prevent authorized separation of the first and second components.

Except for the shield 52 and the pole piece 54, the clutch mechanism 70 is of the same construction and operation as the clutch mechanism 10 shown in FIG. 1.

The clutch mechanism 70 is contained in a dome 80 that extends from the portion of the first component 72 that contains the electronic transponder 76.

The clutch mechanism 70 further includes a ferromagnetic shield 82 that is disposed axially in relation to the anvil 26 for diffusing magnetic flux applied axially to the anvil by means external to the clutch mechanism 70 so as to prevent less than a predetermined amount of said axially applied magnetic flux from overcoming the biasing force applied by the spring 30 and forcing the anvil 26 to move away from the confining end 46 of the cup 28. The shield 82 is positioned in the curved end of the dome 80 at the opposite end of the clutch mechanism 70 from the confining end 46 of the cup 28.

The clutch mechanism 70 is so constructed that magnetic flux must be applied radially to the clutch mechanism 70 in order to force the anvil 26 to overcome the biasing force applied by the spring 30 and move away from the confining end 46 of the cup 28 to release the pin 78 from the grasp of the first set of balls 32 so that the first component 72 can be separated from the second component 78. To axially concentrate radially applied flux in the anvil 26 in order to overcome the biasing force of the spring 30 and force the anvil 26 to move away from the confining end 46 of the cup 28, the clutch mechanism 70 includes a ferromagnetic pole piece 84 that is radially disposed for directing magnetic flux applied radially by means external to the clutch mechanism 70 so that at least a predetermined amount of said radially applied magnetic flux is so concentrated axially in the anvil 26. In this embodiment, the pole piece 84 is a ferromagnetic coaxially-extended ring that is disposed adjacent the confining end of the cup 30.

Magnetic flux is radially applied to the clutch mechanism 70 of the theft deterrent device 74 when the theft deterrent device 74 is positioned in a magnetic flux source apparatus 90 that is particularly designed for radially applying magnetic flux to such clutch mechanism 70. The magnetic flux source apparatus 90 includes a magnet 92 and a ferromagnetic pole piece 94.

The magnet 90 provides in excess of said predetermined amount of magnetic flux, and has a North-South magnetic axis that is aligned with the bore axis 38 of the clutch mechanism 70 when the theft deterrent device 74 is positioned within the magnetic flux source apparatus 90 as shown in FIG. 2. One pole of the magnet 92 contacts the pole piece 94.

The pole piece 94 is disposed coaxially with the magnet 92 and includes a coaxial shell having a base and a vertical wall that terminates in a rim 96 that extends radially toward the axis of the magnet 92 in a plane beyond the magnet 92 for directing magnetic flux in excess of said predetermined amount of magnetic flux radially toward the axis of the magnet 92 in a plane that is beyond the magnet 92 and aligned with the pole piece 84 of the clutch mechanism 70 when the theft deterrent device 74 is positioned within the magnetic flux source apparatus 90 as shown in FIG. 2.

The shape of the pole piece 84 of the clutch mechanism 70 is that of a coaxially-extended ring so that the pole piece better directs the radially applied magnetic flux axially to the anvil 26 when the theft deterrent device 74 is positioned within the magnetic flux source apparatus 90 as shown in FIG. 2. The upper portion of the pole piece 84 that extends beyond the housing 24 flares outward to extend closer to the pole piece 94 of the magnetic flux source apparatus 90 when the theft deterrent device 74 is positioned within the magnetic flux source apparatus 90 as shown in FIG. 2.

When the theft deterrent device 74 is positioned within the magnetic flux source apparatus 90 as shown in FIG. 2, the pole piece 84 of the clutch mechanism 70 is so disposed in relation to the pole piece 94 of the magnetic flux source apparatus 90 as to axially direct the magnetic flux that is applied radially by the pole piece 94 of the magnetic flux source apparatus and to concentrate at least said predetermined amount of said radially applied magnetic flux in the anvil 26 to thereby overcome the bias force applied by the spring 30 and force the anvil 26 to move away from the confining end 46 of the cup 28.

In an alternative preferred embodiment (not shown), a clutch mechanism for a theft deterrent device having a configuration as shown in FIG. 1, includes all of the components of the clutch mechanism 10 described with reference to FIG. 1 and further includes a ferromagnetic coaxially-extended-ring pole piece, such as the pole piece 84 included in the embodiment of FIG. 2, with such additional pole piece being disposed adjacent the confining end of the cup 30, in the same manner as the pole piece 84.

I claim:

1. A clutch mechanism for restraining a pin from longitudinal movement, comprising a ferromagnetic anvil having an axial bore for axially receiving a pin;

receiving means axially aligned with the anvil for axially receiving a said pin that is axially received by the bore of the anvil, wherein the anvil is longitudinally movable along its bore axis with respect to the receiving means;

biasing means for forcing the anvil toward a first end of the receiving means;

clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means; and means separate from said receiving means and disposed axially in relation to the anvil for diffusing magnetic flux applied axially to the anvil by means external to the mechanism so as to prevent less than a predetermined amount of said axially applied magnetic flux from overcoming the biasing means and forcing the anvil to move away from the first end of the receiving means;

wherein the anvil is disposed between the receiving means and the diffusing means.

2. A mechanism according to claim 1, further comprising a radially disposed pole piece for directing magnetic flux applied radially by means external to the mechanism so that at least a predetermined amount of said radially applied magnetic flux is so concentrated axially in the anvil as to overcome the biasing means and force the anvil to move away from the first end of the receiving means.

3. A mechanism according to claim 2, wherein the pole piece includes a ferromagnetic disc-shaped ring disposed adjacent the first end of the receiving means in a plane that is perpendicular to said axis.

4. A mechanism according to claim 2, wherein the pole piece includes a ferromagnetic axially-extended ring disposed adjacent the first end of the receiving means and coaxial with said axis.

5. A ball and clutch mechanism for restraining a pin from longitudinal movement, comprising a ferromagnetic anvil having an axial bore for axially receiving a pin;

a radially symmetrical cup having a confining end, a tapered interior wall and a predominantly open end covering the anvil and axially aligned with the anvil for axially receiving a said pin that is axially received by the bore of the anvil, wherein the anvil is longitudinally movable along its bore axis with respect to the cup;

biasing means for forcing the anvil toward the confining end of the cup;

a first set of a given number of uniformly dimensioned balls in the cup, engaging the anvil and forced by the anvil toward the confining end of the cup when the anvil is forced toward the confining end of the cup by the biasing means;

a second set of the given number of uniformly dimensioned balls in the extreme confining end of the cup for clutching a said pin axially received by the cup and the bore of the anvil, wherein the interior wall of the cup is dimensioned and tapered with respect to the balls to cause the balls of the first and second sets to be in different radial planes and to cause the balls of the second set to contact the pin and wherein when the balls of the first set are forced toward the confining end of the cup, the balls of the first set wedge the balls of the second set between the tapered interior wall of the cup and the pin and uniformly space the balls of the second set to apply symmetrical radial pressure against said pin to firmly clutch the pin and thereby restrain said pin from longitudinal movement; and means disposed axially in relation to the anvil for diffusing magnetic flux applied axially to the anvil by means external to the mechanism so as to prevent less than a predetermined amount of said axially applied magnetic flux from overcoming the biasing means and forcing the anvil to move away from the confining end of the cup.

6. A mechanism according to claim 5, further comprising a radially disposed pole piece for directing magnetic flux applied radially by means external to the mechanism so that at least a predetermined amount of said radially applied magnetic flux is so concentrated axially in the anvil as to overcome the biasing means and force the anvil to move away from the confining end of the cup.

7. A mechanism according to claim 6, wherein the pole piece includes a ferromagnetic disc-shaped ring disposed adjacent the first end of the receiving means in a plane that is perpendicular to said axis.

8. A mechanism according to claim 6, wherein the pole piece includes a ferromagnetic axially-extended ring disposed adjacent the first end of the receiving means and coaxial with said axis.

9. A device for deterring theft of a protected article, comprising means for attaching the device to the article, with said attaching means being embodied in two components that are adapted to be locked together on opposite sides of a portion of said article to prevent unauthorized removal of the device from the article, wherein the attaching means include a pin having a head within one component and a clutch mechanism contained in the other component for grasping the pin to provide a predetermined restraining force for resisting separation of the components by prying or pulling the components apart, wherein the clutch mechanism comprises a ferromagnetic anvil having an axial bore for axially receiving a pin;

receiving means axially aligned with the anvil for axially receiving a said pin that is axially received by the bore of the anvil, wherein the anvil is longitudinally movable along its bore axis with respect to the receiving means;

blasing means for forcing the anvil toward a first end of the receiving means;

clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means; and means separate from said receiving means and disposed axially in relation to the anvil for diffusing magnetic flux applied axially to the anvil by means external to the mechanism so as to prevent less than a predetermined amount of said axially applied magnetic flux from overcoming the biasing means and forcing the anvil to move away from the first end of the receiving means;

wherein the anvil is disposed between the receiving means and the diffusing means.

10. A device according to claim 9, further comprising a radially disposed pole piece for directing magnetic flux applied radially by means external to the mechanism so that at least a predetermined amount of said radially applied magnetic flux is so concentrated axially in the anvil as to overcome the biasing means and force the anvil to move away from the first end of the receiving means.

11. In combination, a clutch mechanism for restraining a pin from longitudinal movement, comprising a ferromagnetic anvil having an axial bore for axially receiving a pin;

receiving means axially aligned with the anvil for axially receiving a said pin that is axially received by the bore of the anvil, wherein the anvil is longitudinally movable along its bore axis with respect to the receiving means;

biasing means for forcing the anvil toward a first end of the receiving means;

clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means; and a radially disposed pole piece for directing magnetic flux applied radially by means external to the mechanism so that at least a predetermined amount of said radially applied magnetic flux is so concentrated axially in the anvil as to overcome the biasing means and force the anvil to move away from the first end of the receiving means; and a magnetic flux source apparatus, comprising an axially disposed magnet for providing in excess of said predetermined amount of magnetic flux;

a pole piece coupled to the magnet and disposed coaxially with the magnet for applying in excess of said predetermined amount of magnetic flux radially toward the axis of the magnet in a plane that is beyond the magnet; and means for receiving the clutch mechanism in a position in which the pole piece of the clutch mechanism is so disposed in relation to the pole piece of the magnetic flux source apparatus as to direct magnetic flux applied radially by the pole piece of the magnetic flux source apparatus and to concentrate at least said predetermined amount of said radially applied magnetic flux in the anvil to thereby overcome the biasing means and force the anvil to move away from the first end of the receiving means.

12. A combination according to claim 11, wherein the pole piece of the clutch mechanism includes a ferromagnetic disc-shaped ring disposed adjacent the first end of the receiving means in a plane that is perpendicular to said axis; and wherein the pole piece of the magnetic flux source apparatus terminates in a rim that is adjacent the ferromagnetic disc-shaped ring of the clutch mechanism when the clutch mechanism is received in said position by the flux source apparatus.

13. A combination according to claim 11, wherein the pole piece of the clutch mechanism includes a ferromagnetic axially-extended ring disposed adjacent the first end of the receiving means and coaxial with said axis; and wherein the pole piece of the magnetic flux source apparatus terminates in a rim that extends radially toward said axis and is disposed adjacent the ferromagnetic axially-extended ring of the clutch mechanism when the clutch mechanism is received in said position by the flux source apparatus.

14. A method of removing a pin from a clutch mechanism that includes a ferromagnetic anvil having an axial bore for axially receiving a pin; receiving means axially aligned with the anvil for axially receiving a said pin that is axially received by the bore of the anvil, wherein the anvil is longitudinally movable along its bore axis with respect to the receiving means; biasing means for forcing the anvil toward a first end of the receiving means; clutching means engaging the anvil and forced by the anvil toward the first end of the receiving means when the anvil is forced toward the first end of the receiving means by the biasing means, with the clutching means being disposed to apply radial pressure against said pin to firmly clutch the pin and thereby restrain said pin from longitudinal movement when the clutching means are forced toward the first end of the receiving means; and a radially disposed pole piece for directing magnetic flux applied radially by means external to the mechanism so that at least a predetermined amount of said radially applied magnetic flux is so concentrated axially in the anvil as to overcome the biasing means and force the anvil to move away from the first end of the receiving means, said method comprising the step of externally radially applying toward a region adjacent the first end of said receiving means of the clutch mechanism an amount of magnetic flux in excess of said predetermined amount of magnetic flux.

15. A method according to claim 14, wherein said step is accomplished by the steps of (a) providing a magnetic flux source apparatus, comprising an axially disposed magnet for providing in excess of said predetermined amount of magnetic flux; and a pole piece coupled to the magnet and disposed coaxially with the magnet for applying in excess of said predetermined amount of magnetic flux radially toward the axis of the magnet in a plane that is beyond the magnet; and (b) receiving the clutch mechanism within the magnetic flux source apparatus in a position in which the pole piece of the clutch mechanism is so disposed in relation to the pole piece of the magnetic flux source apparatus as to direct magnetic flux applied radially by the pole piece of the magnetic flux source apparatus and to concentrate at least said predetermined amount of said radially applied magnetic flux in the anvil to thereby overcome the biasing means and force the anvil to move away from the first end of the receiving means.

* * * * *